US011830685B2

(12) United States Patent
Ku

(10) Patent No.: US 11,830,685 B2
(45) Date of Patent: Nov. 28, 2023

(54) LONG KEY DEVICE

(71) Applicant: SUNREX TECHNOLOGY CORP., Taichung (TW)

(72) Inventor: Chih-Po Ku, Taichung (TW)

(73) Assignee: Sunrex Technology Corp., Taichung (TW)

( * ) Notice: Subject to any disclaimer, the term of this patent is extended or adjusted under 35 U.S.C. 154(b) by 0 days.

(21) Appl. No.: 17/895,387

(22) Filed: Aug. 25, 2022

(65) Prior Publication Data

US 2023/0282428 A1 Sep. 7, 2023

(30) Foreign Application Priority Data

Mar. 7, 2022 (TW) ..... 111202244

(51) Int. Cl.
*H01H 13/14* (2006.01)
*H01H 13/04* (2006.01)
*H01H 13/20* (2006.01)

(52) U.S. Cl.
CPC ..... *H01H 13/14* (2013.01); *H01H 13/04* (2013.01); *H01H 13/20* (2013.01); *H01H 2233/07* (2013.01)

(58) Field of Classification Search
CPC ..... H01H 13/14; H01H 13/04; H01H 13/20; H01H 2233/07; H01H 3/12; H01H 3/122; H01H 3/125; H01H 13/70; H01H 13/702; H01H 13/705; H01H 13/7065
See application file for complete search history.

(56) References Cited

U.S. PATENT DOCUMENTS

| | | | | |
|---|---|---|---|---|
| 9,455,096 | B2 * | 9/2016 | Chen | H01H 3/125 |
| 2022/0189715 | A1 * | 6/2022 | Hsu | H01H 3/125 |
| 2023/0084860 | A1 * | 3/2023 | Ning | H01H 13/04 |

* cited by examiner

*Primary Examiner* — Lheiren Mae A Caroc
(74) *Attorney, Agent, or Firm* — Burris Law, PLLC

(57) ABSTRACT

A long key device includes a base plate, a keycap, and a scissor mechanism. The scissor mechanism includes a first scissor frame and a second scissor frame. The first scissor frame defines an opening, and has two ends pivotally and respectively connected to the base plate and the keycap. The second scissor frame is disposed in the opening, has two first ends pivotally and respectively coupled to the first scissor frame, and two second ends pivotally and respectively connected to the base plate and the keycap. Each of the first and second scissor frames has parts that are connected to the base plate, the other one of the first and second scissor frame, and the keycap, and that are made of plastic.

15 Claims, 11 Drawing Sheets

LONG KEY DEVICE

CROSS-REFERENCE TO RELATED APPLICATIONS

This application claims priority of Taiwanese Utility Model Patent Application No. 111202244, filed on Mar. 7, 2022.

FIELD

The disclosure relates to a key device, more particularly to a long key device.

BACKGROUND

A conventional long key device for use as a space bar includes a base plate extending in an axial direction, a thin film circuit board disposed on the base plate, an elastomeric component disposed on the thin film circuit board, two balance rods, two scissor mechanism modules, and a keycap. The balance rods are disposed on the base plate, extend in the axial direction, and are spaced apart in a direction perpendicular to the axial direction. The scissor mechanism modules are disposed on the base plate between the balance rods, are spaced apart in the axial direction, and are located respectively on opposite sides of the elastomeric component. The keycap extends in the axial direction and disposed on the balance rods and the scissor mechanism modules.

When the keycap is depressed, the keycap can be kept level and lowered smoothly and steadily by virtue of the balance rods. Nonetheless, the installation of the balancing rods means that the conventional long key device has more parts than the non-long key. During assembly of the conventional long key device, the scissor mechanism modules and the base plate may easily be damaged. Besides, during operation of the conventional long key device, the balance rods will collide with the base plate or the keycap to produce noise.

SUMMARY

Therefore, the object of the disclosure is to provide a long key device that can alleviate at least one of the above disadvantages.

According to the disclosure, the long key device includes a base plate, a thin film circuit board, an elastomeric component, a keycap, and a scissor mechanism. The base plate extends in a longitudinal direction. The thin film circuit board extends in the longitudinal direction and is disposed on the base plate. The elastomeric component is disposed on a side of the thin film circuit board that is opposite to the base plate. The keycap extends in the longitudinal direction and is located above the elastomeric component. The scissor mechanism is disposed between the base plate and the keycap, and is elongated along a longitudinal axis that extends in the longitudinal direction. The scissor mechanism includes a first scissor frame and a second scissor frame.

The first scissor frame defines an opening, and has two ends disposed respectively at opposite sides of the longitudinal axis, and pivotally and respectively connected to the base plate and the keycap. The second scissor frame is disposed in the opening, has two first ends opposite to each other along the longitudinal axis and pivotally and respectively coupled to the first scissor frame, and two second ends disposed respectively at opposite sides of the longitudinal axis, and pivotally and respectively connected to the base plate and the keycap. The second scissor frame further has a through hole through which the elastomeric component passes. The first scissor frame has parts that are connected to the base plate, the second scissor frame, and the keycap, and that are made of plastic. The second scissor frame has parts that are connected to the base plate, the first scissor frame and the keycap, and that are made of plastic.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
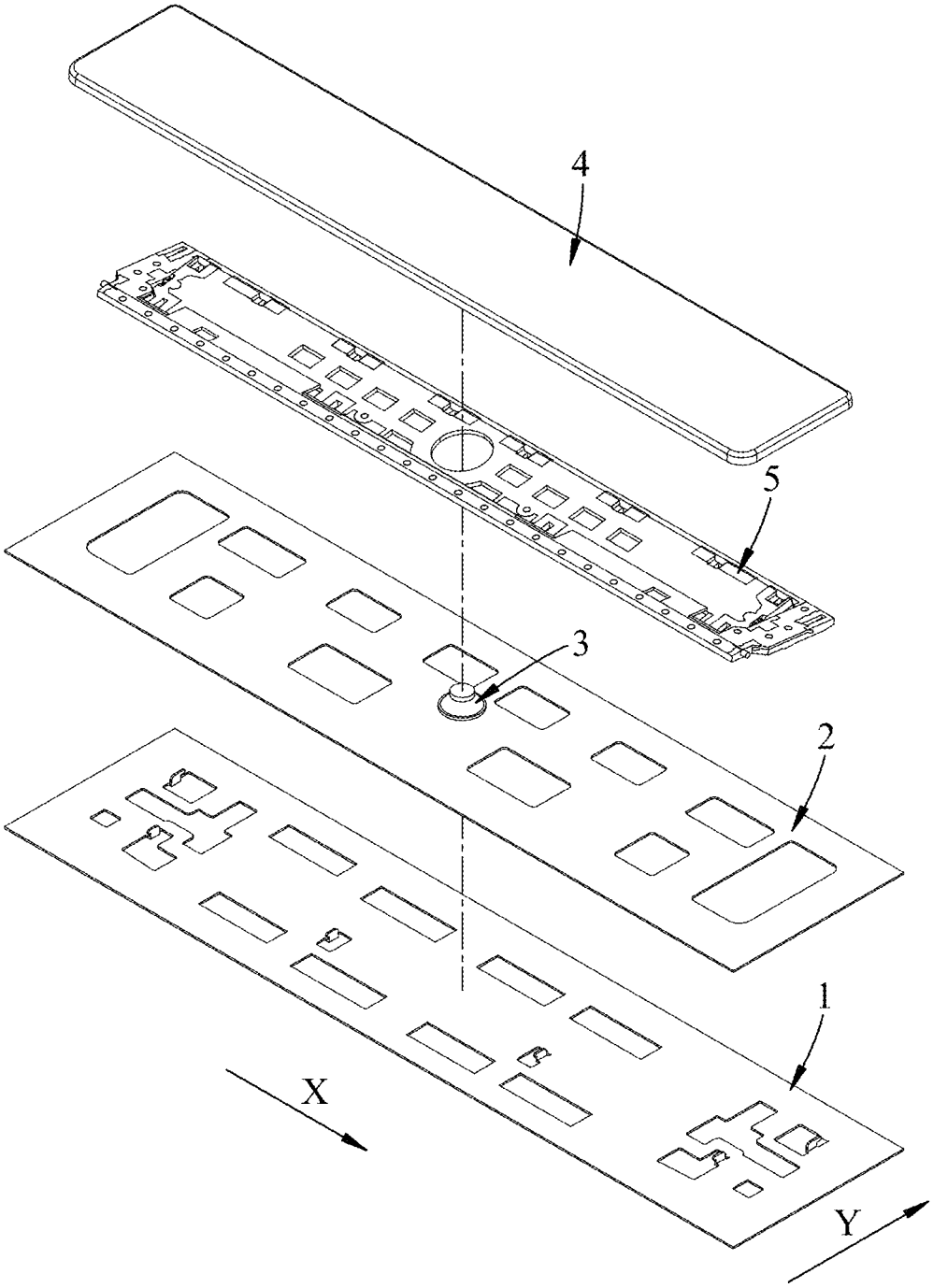
FIG. 1 is a partly exploded perspective view of an embodiment of a long key device according to the disclosure.
Figure 2:
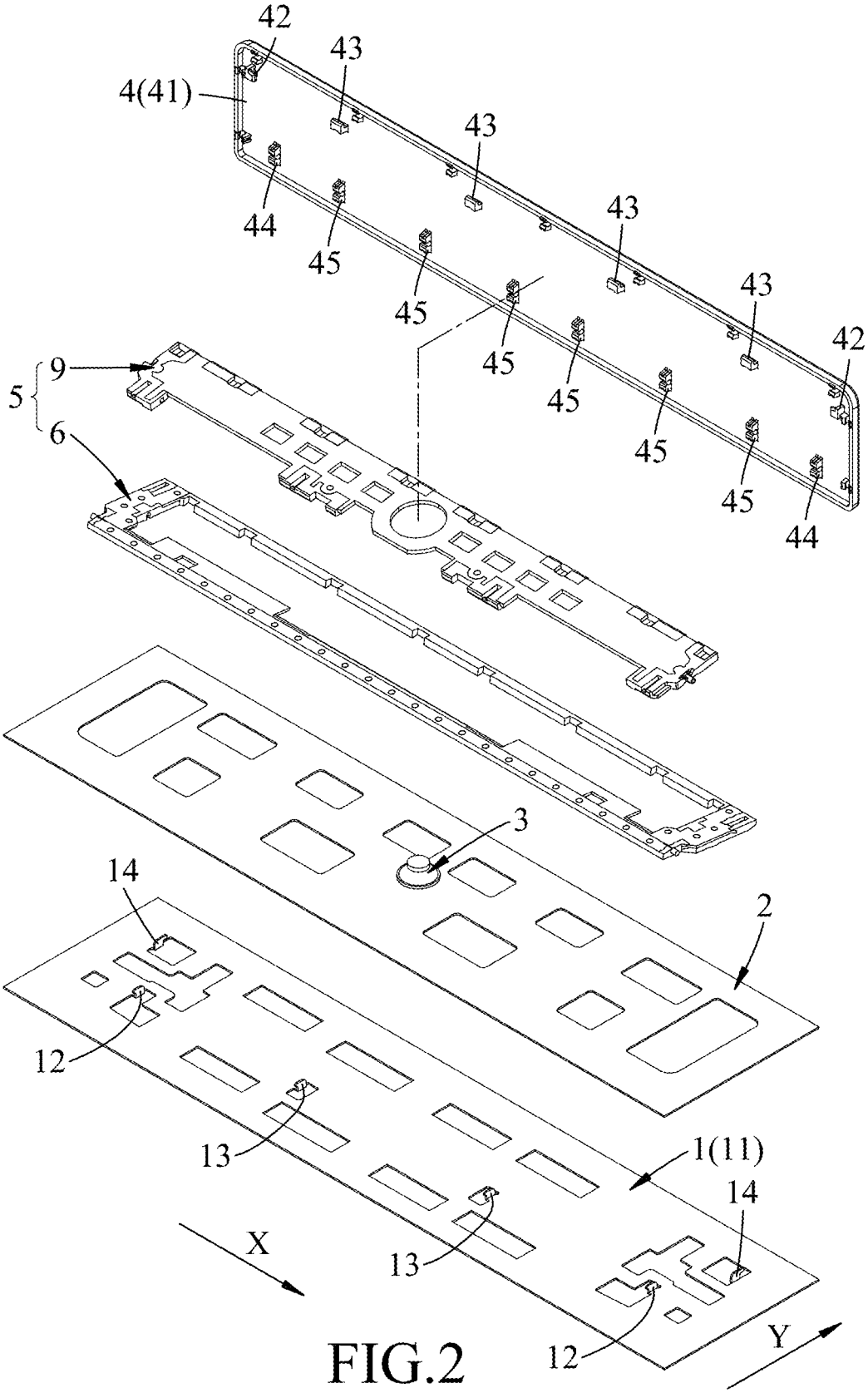
FIG. 2 is an exploded perspective view of the embodiment.
Figure 3:
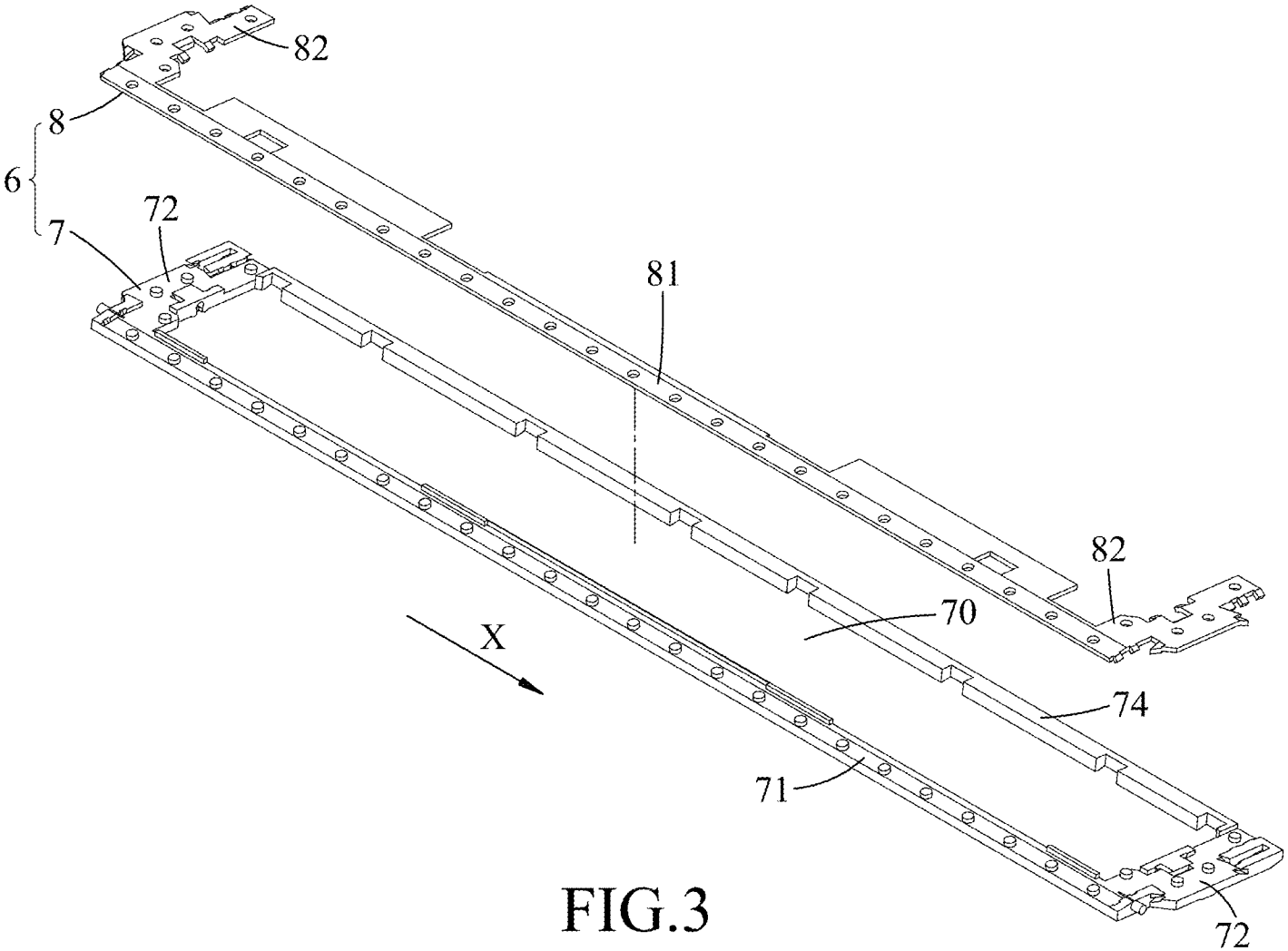
FIG. 3 is an exploded perspective view of a first scissor frame of the embodiment.

As shown in FIGS. 1 and 2, the embodiment of long key device according to the present disclosure includes a base plate 1, a thin film circuit board 2, an elastomeric component 3, a keycap 4, and a scissor mechanism 5.

The base plate 1 includes a plate body portion 11 extending in a longitudinal direction (X), two lateral hook portions 12 disposed on the plate body portion 11 and spaced apart in the longitudinal direction (X), two first hook portions 13 disposed on the plate body portion 11 and located between the two lateral hook portions 12, and two second hook portions 14 disposed on the plate body portion 11 and spaced apart in the longitudinal direction (X). The group of the first hook portions 13 and the group of the second hook portions 14 are spaced apart in a width direction (Y) that is perpendicular to the longitudinal direction (X). The thin film circuit board 2 is disposed on the plate body portion 11 of the base plate 1 and extends in the longitudinal direction (X). The elastomeric component 3 is disposed on a side of the thin film circuit board 2 opposite to the base plate 1.

The keycap 4 extends in the longitudinal direction (X) and is located above the elastomeric component 3. The keycap 4 has a cap body 41 located above the scissor mechanism 5, two first pivoting mounting brackets 42 disposed on a lower surface of the cap body 41 and spaced apart in the longitudinal direction (X), four first engaging brackets 43 disposed on the lower surface of the cap body 41 and distributed between the two first pivoting mounting brackets 42, two second pivoting mounting brackets 44 spaced apart from the first pivoting mounting brackets 42 in the width direction (Y) and spaced apart from each other in the longitudinal direction (X), and six second engaging brackets 45 distributed between the two second pivoting mounting brackets 44.

Figure 4:
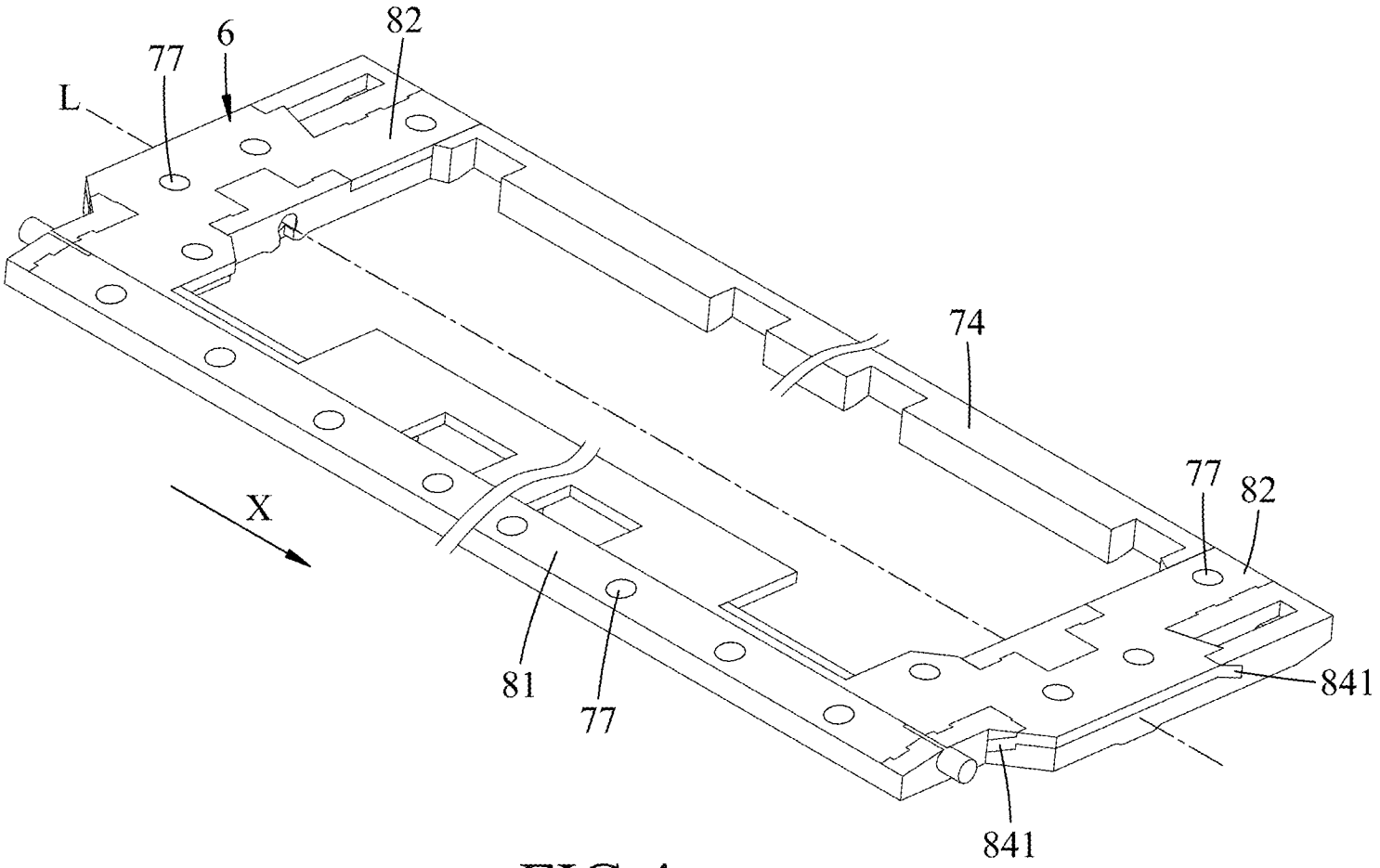
FIG. 4 is a fragmentary perspective view of the first scissor frame.
Figure 5:
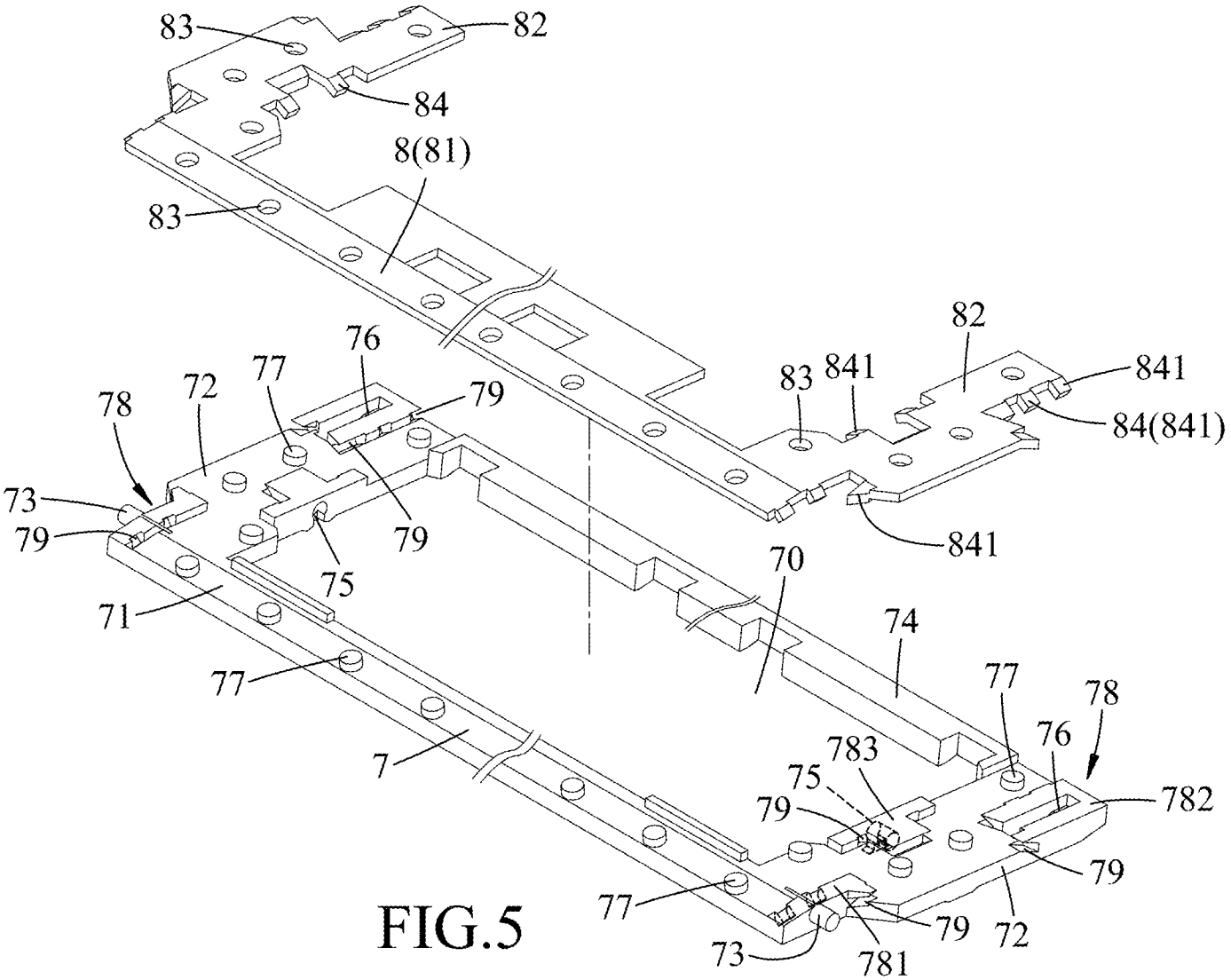
FIG. 5 is a fragmentary exploded perspective view of the first scissor frame.

The scissor mechanism 5 is positioned between the base plate 1 and the keycap 4, is elongated along a longitudinal axis (L) that extends in the longitudinal direction (X) (see FIG. 4), and includes a first scissor frame 6 and a second scissor frame 9.

Referring to FIGS. 2 to 5, the first scissor frame 6 extends in the longitudinal direction (X) and defines an opening 70. The first scissor frame 6 has two opposite sides that are disposed respectively at opposite sides of the longitudinal axis (L), and that are pivotally and respectively connected to the base plate 1 and the keycap 4.

The first scissor frame 6 includes a first scissor frame body 7 and an insert body 8.

The first scissor frame body 7 is made of plastic, defines the opening 70, and is pivotally connected to the base plate 1, the second scissor frame 9, and the keycap 4.

The first scissor frame body 7 has a first side bar 71, two lateral bars 72, two first retaining parts 73, a second side bar 74, two shaft holes 75, two second retaining parts 76, a plurality of studs 77, and two convex bump units 78. The first side bar 71 extends in the longitudinal direction (X), and is detachably and pivotally connected to the first engaging brackets 43 of the keycap 4. Each lateral bar 72 is perpendicular to the first side bar 71 and has opposite first and second ends. The first ends of the lateral bars 72 are connected respectively to opposite ends of the first side bar 71. The lateral bars 72 are respectively and pivotally connected to the first ends of the second scissor frame 9. The first retaining parts 73 project from the two lateral bars 72, and are respectively, detachably, and pivotally connected to the first pivoting mounting brackets 42. The second side bar 74 is connected between the second ends of the two lateral bars 72, and cooperates with the first side bar 71 and the two lateral bars 72 to define the opening 70. The shaft holes 75 are formed in the two lateral bars 72 respectively and face the opening 70. The second retaining parts 76 are disposed respectively on the two lateral bars 72, and are respectively, detachably, and pivotally connect to the second hook portions 14. The studs 77 protrude from the first side bar 71 and the lateral bars 72. The bump units 78 protrude from the lateral bars 72, respectively. Thereby, the first and second ends of each lateral bar 72 are pivotally and respectively connected to the keycap 4 and the base plate 1.

Each bump unit 78 cooperates with the respective lateral bar 72 to form a plurality of engagement spaces 79. In this embodiment, each bump unit 78 has a first bump 781 adjacent to the first side bar 71, a second bump 782 proximate to the second side bar 74, and a third bump 783 adjacent to the opening 70. The engagement spaces 79 are formed between the respective lateral bar 72 and the first bump 781, the second bump 782, and the third bump 783 of each bump unit 78.

The insert body 8 is U-shaped, is made of metal, and is engaged to the first scissor frame body 7. In this embodiment, the insert body 8 has a linking panel 81, two lateral panels 82, a plurality of clip holes 83, and two protrusion units 84. The linking panel 81 extends in the longitudinal direction (X) and is fitted on the upper side of the first side bar 71. The lateral panels 82 are spaced apart in the longitudinal direction (X), are connected to the linking panel 81, and are fitted on upper sides of the two lateral bars 72, respectively. The clip holes 83 are formed in the linking panel 81 and the lateral panels 82. The studs 77 are detachably and respectively engaged with the clip holes 83. The protrusion units 84 protrude respectively from the two lateral panels 82. Each protrusion unit 84 includes a plurality of protrusions 841 engaged respectively with the engagement spaces 79 on the respective lateral bar 72.

Figure 6:
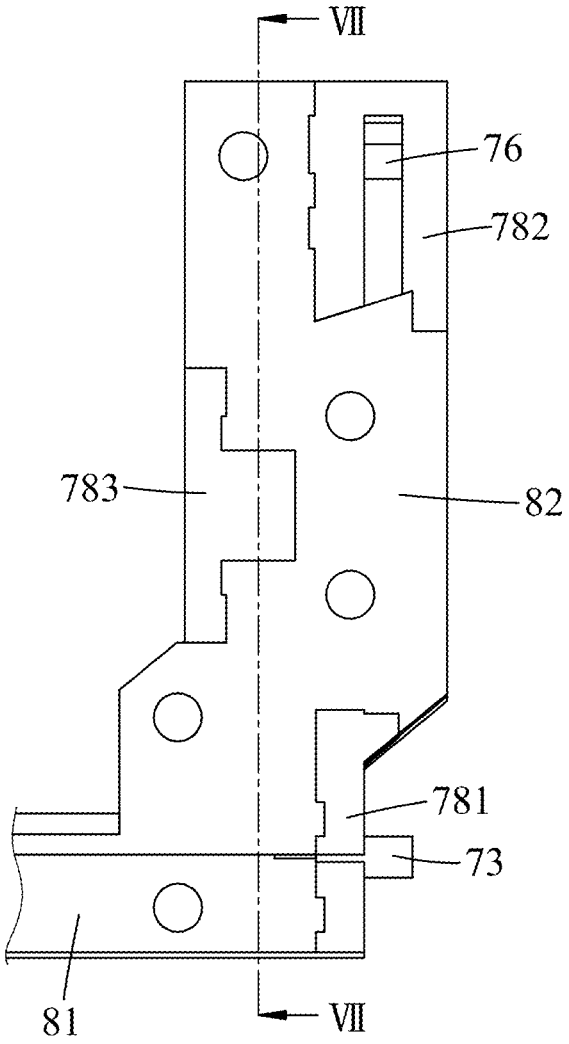
FIG. 6 is a fragmentary top view of the first scissor frame.
Figure 7:
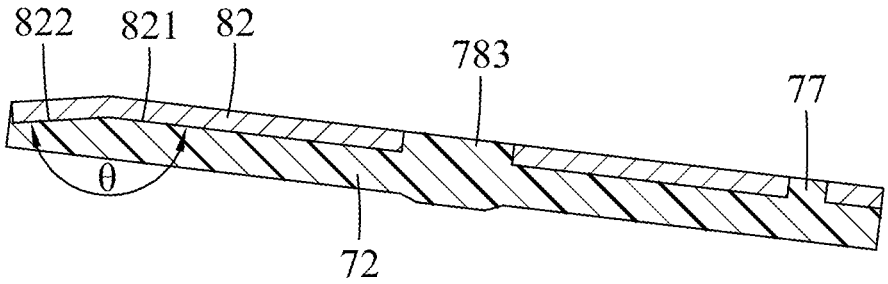
FIG. 7 is a sectional view of the first scissor frame taken along line VII-VII in FIG. 6.

Referring to FIGS. 6 and 7, each lateral panel 82 has a first lower surface 821 abutting against the respective lateral bar 72, and a second lower surface 822 extending from the first lower surface 821, connected to the linking panel 81, and abutting against the respective lateral bar 72. Each lateral panel 82 has a portion that is adjacent to the connected panel 81 and that is bent, and the first and second lower surfaces 821, 822 cooperatively define a strengthening angle (θ) ranging from 99° to 178°. In this embodiment, the strengthening angle (θ) is 170°.

In this embodiment, the first scissor frame 6 is formed through overmolding, in which the insert body 8 is pre-positioned in the injection mold prior to molding.

Moreover, because each lateral panel 82 is bent adjacent to the linking panel 81, with the strengthening angle (θ) incorporated between the first lower surface 821 and the contiguous second lower surface 822, the bonding strength of the insert body 8 and the first scissor frame body 7 can be enhanced.

Figure 8:
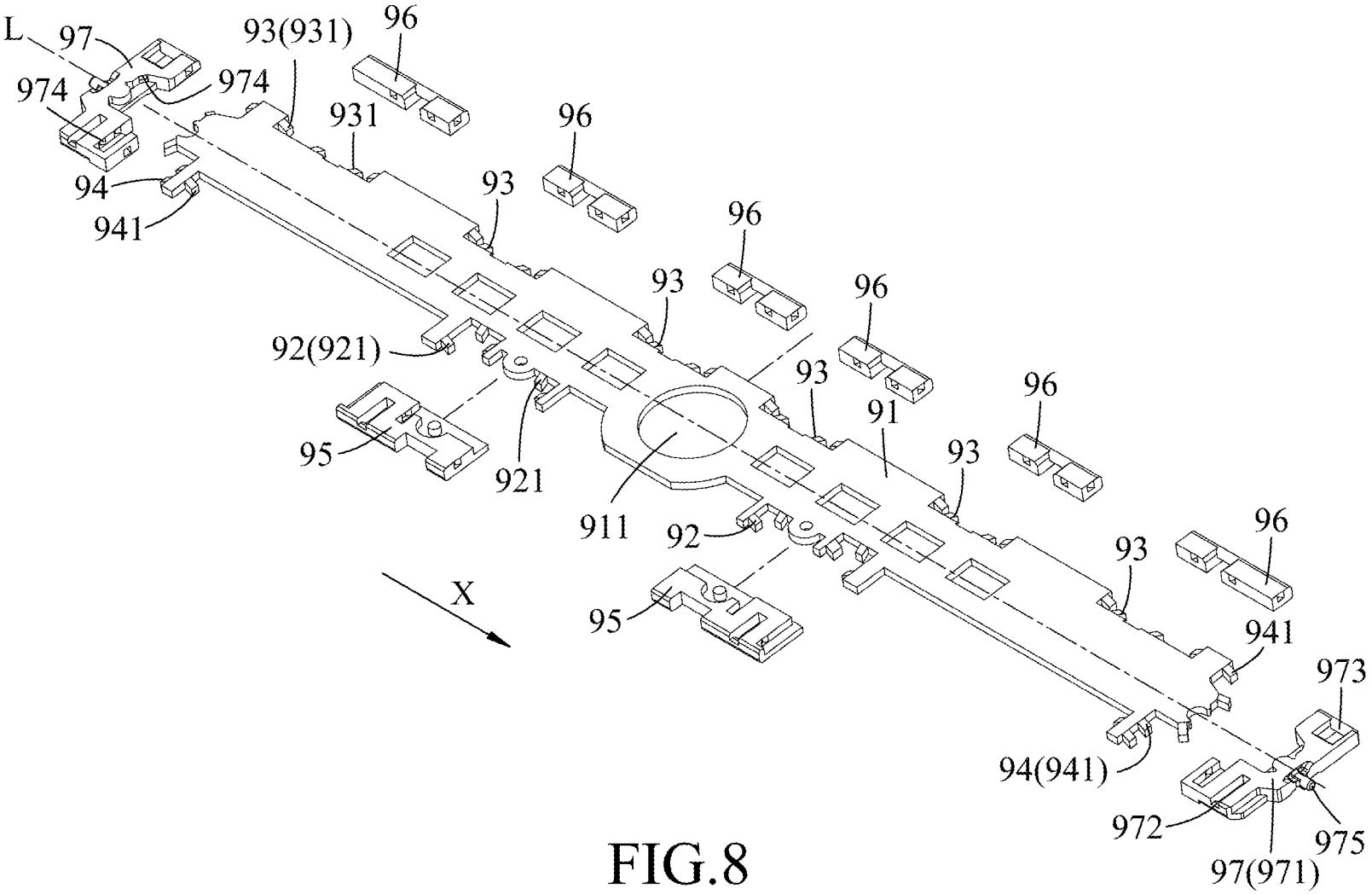
FIG. 8 is an exploded perspective view of a second scissor frame of the embodiment.
Figure 9:
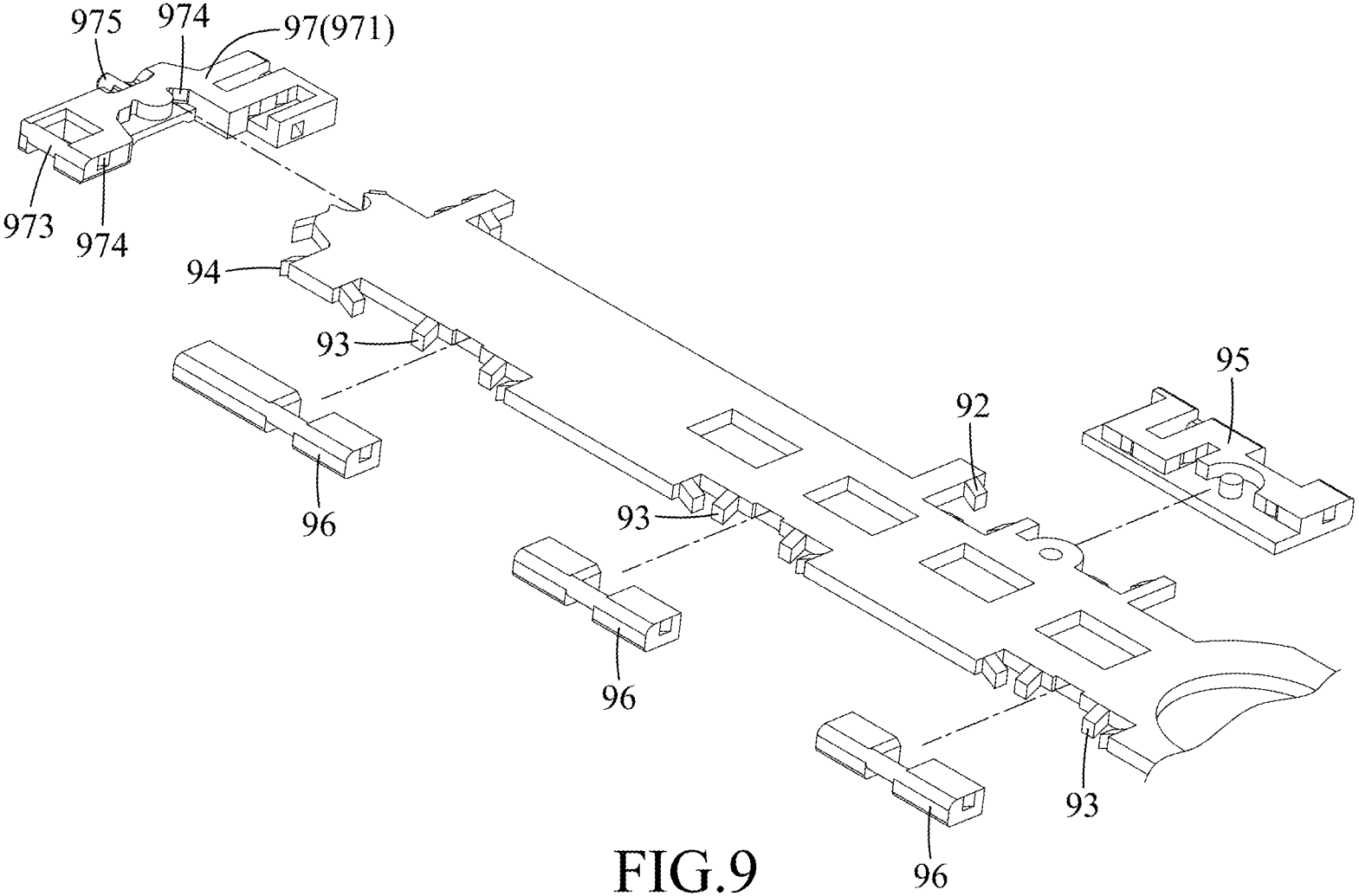
FIG. 9 is a fragmentary exploded perspective view of the second scissor frame.

Referring to FIGS. 2 and 8 to 9, the second scissor frame 9 is disposed in the opening 70, and has two first ends that are opposite to each other along the longitudinal axis (L) and that are respectively and pivotally coupled to the first scissor frame 6, and two second ends that are disposed respectively at opposite sides of the longitudinal axis (L), and that are pivotally and respectively connected to the base plate 1 and the keycap 4. The second scissor frame 9 further has a through hole 911 through which the elastomeric component 3 passes. In this embodiment, the second scissor frame 9 has a second scissor frame body 91, two first protrusion units 92, six second protrusion units 93, two lateral protrusion units 94, two first interlocking members 95, six second interlocking members 96, and two lateral interlocking members 97.

The second scissor frame body 91 is disposed in the opening 70, is made of metal, is elongated along the longitudinal axis (L), and has the through hole 911.

The first protrusion units 92 are disposed at one of the second ends of the second scissor frame 9, and the second protrusion units 93 are disposed at the other one of the second ends of the second scissor frame 9. Specifically, the two first protrusion units 92 are disposed on the second scissor frame body 91 and are spaced apart in the longitudinal direction (X). Each first protrusion unit 92 has a plurality of first protrusions 921 protruding from the second scissor frame body 91.

The six second protrusion units 93 are spaced apart in the longitudinal direction (X) and are disposed on the second scissor frame body 91. Each second protrusion units 93 has a plurality of second protrusions 931 protruding from the second scissor frame body 91.

The lateral protrusion units 94 are respectively disposed on opposite sides of the second scissor frame body 91 along the longitudinal axis (L). Each lateral protrusion unit 94 has a plurality of lateral protrusions 941 protruding from the second scissor frame body 91.

The first interlocking members 95 and the second interlocking members 96 are made of plastic. The first interlocking members 95 are engaged respectively with the first protrusion units 92. Each first interlocking member 95 fits with the first protrusions 921 of the respective first protrusion unit 92. Each first interlocking member 95 is detachably and pivotally connected to the respective first hook portion 13.

The second interlocking members 96 are evenly spaced apart in the longitudinal direction (X), and are respectively engaged with the second protrusion units 93. Each second interlocking member 96 fits with the second protrusions 931 of the respective second protrusion unit 93. Each second interlocking member 96 is detachably and pivotally connected to the respective second engaging bracket 45.

The lateral interlocking members 97 are made of plastic and are engaged respectively with opposite sides of the second scissor frame body 91 along the longitudinal axis (L), are disposed respectively at the second ends of the second scissor frame 9, and are pivotally connected to the first scissor frame 6. Each lateral interlocking member 97 has opposite ends that are disposed respectively at opposite sides of the longitudinal axis (L), and that are pivotally and respectively connected to the base plate 1 and the keycap 4.

In this embodiment, each lateral interlocking member 97 has a lateral interlocking member body 971, a first pivot rod 972, a second pivot rod 973, a plurality of engaging grooves 974, and a shaft rod 975. The lateral interlocking member body 971 is engaged with a respective lateral protrusion unit 94. The first pivot rod 972 is connected to the lateral interlocking member body 971, is disposed at one side of the longitudinal axis (L), and is detachably and pivotally connected to a respective lateral hook portion 12. The second pivot rod 973 is connected to the lateral interlocking member body 971, is disposed at an opposite side of the longitudinal axis (L), and is detachably and pivotally connected to a respective pivoting mounting bracket 44. The shaft rod 975 protrudes from the lateral interlocking member body 971 and is rotatably engaged with a respective shaft hole 75. The engaging grooves 974 formed in a side of the lateral interlocking member body 971 that is opposite to the shaft rod 975. The lateral protrusions 941 of each lateral protrusion unit 94 are respectively engaged with the engaging grooves 974 of the respective lateral interlocking member 97. In other variations of this embodiment, the number of the first interlocking members 95 and the second interlocking members 96 may be only one or it may be other numbers.

In this embodiment, the second scissor frame 9 is formed through overmolding, in which the first protrusion units 92, the second protrusion units 93, the lateral protrusion units 94, the first interlocking members 95, the second interlocking members 96, and the lateral interlocking members 97 are pre-positioned in the injection mold prior to molding.

Figure 10:
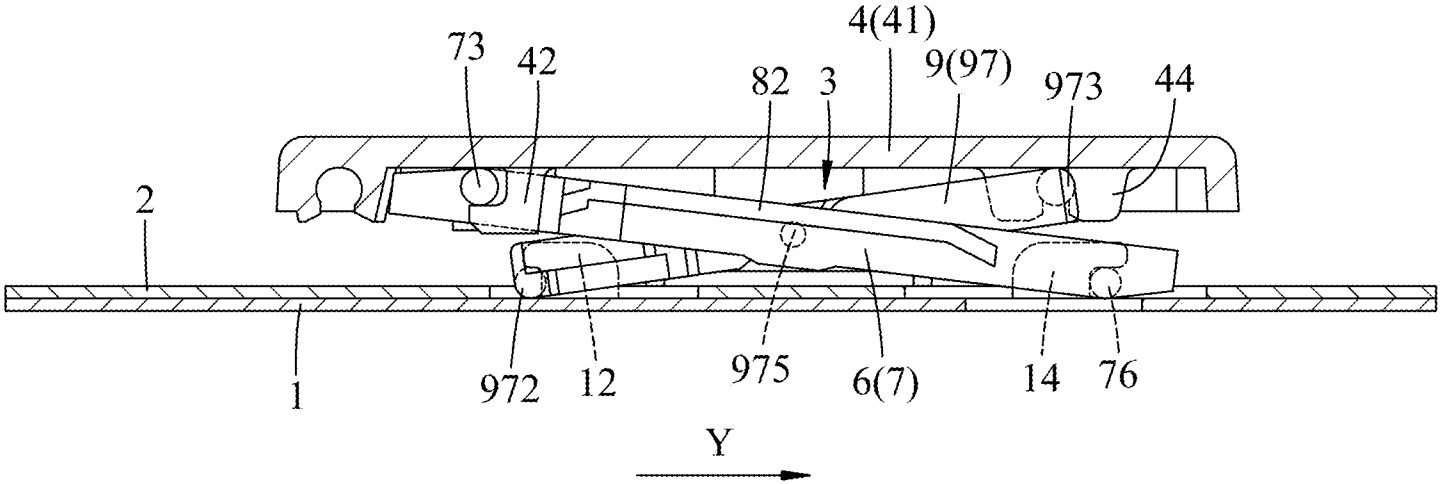
FIG. 10 is a partly cross-sectional view illustrating the state in which a keycap of this embodiment is not depressed.
Figure 11:
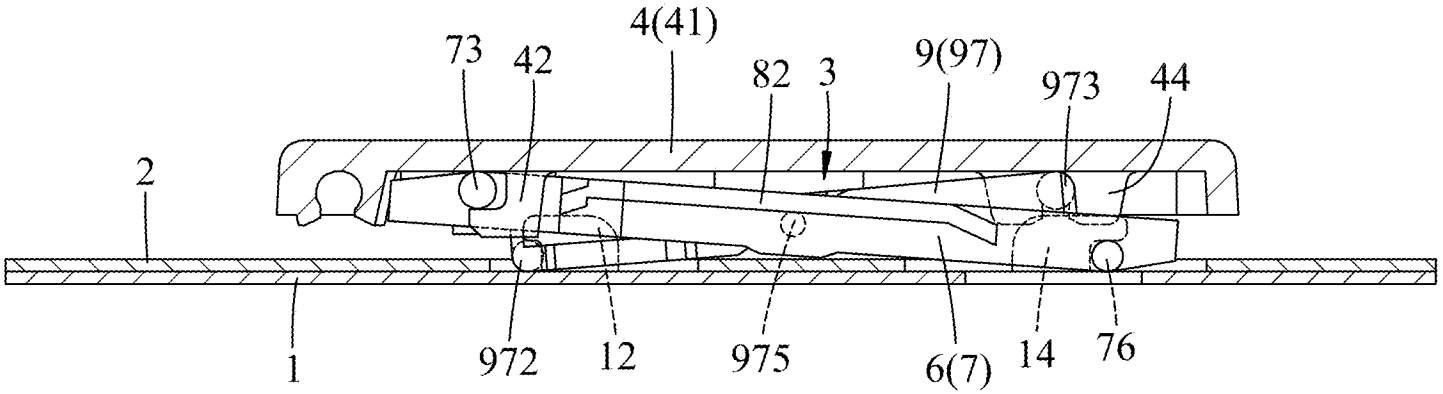
FIG. 11 is a view similar to FIG. 10, illustrating the state in which the keycap of this embodiment is depressed.

Referring to FIGS. 2, 10 and 11, in this embodiment, the keycap 4 can move levelly and steady toward the thin film circuit board 2 when pressed to squeeze the elastomeric component 3. Because the parts of the first scissor frame 6 that are pivotally connected with the second hook portions 14 of the base plate 1, the second scissor frame 9, and the keycap 4 are made of plastic, and the parts of the second scissor frame 9 that are pivotally connected with the lateral hook portions 12 and the first hook portions 13 of the base plate 1, the first scissor frame 6, and the keycap 14 are made of plastic, when the scissors mechanism 5 is assembled to the base plate 1, the first scissor frame 6 and the second scissor frame 9 will have less impact on the second hook portions 14, the first hook portions 13, and the lateral hook portions 12. In addition, the sound produced by a collision between the first scissor frame 6, the second scissor frame 9, the keycap 4, and the base plate 1 when the keycap 4 is depressed can be reduced.

In this embodiment, the first scissor frame 6 and the second scissor frame 9 are both made of plastics and metal, so that the structural strength of the scissor mechanism 5 can be enhanced. In a variation of the embodiment, the scissor mechanism 5 may have only one of the first scissor frame 6 and the second scissor frame 9 made of plastics and metal.

In brief, in the long key device of the present disclosure, by virtue of the first side bar 71 of the first scissor frame 6 and the second interlocking members 96 of the second scissor frame 9 being pivotally connected to the keycap 4, the keycap 4 can move levelly and steadily toward the thin film circuit board 2 when depressed. Moreover, by virtue of the first scissor frame 6 and the second scissor frame 9 being formed by combining plastic and metal, the strength of the scissor mechanism 5 can be improved. Due to the omission of balance rods illustrated in the abovementioned prior art, the noise produced by the collision of balance rods and other components is prevented.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes united together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A long key device comprising:

a base plate extending in a longitudinal direction;

a thin film circuit board extending in said longitudinal direction and disposed on said base plate;

an elastomeric component disposed on a side of said thin film circuit board that is opposite to said base plate;

a keycap extending in said longitudinal direction and located above said elastomeric component; and a scissor mechanism disposed between said base plate and said keycap, and being elongated along a longitudinal axis that extends in said longitudinal direction, said scissor mechanism including a first scissor frame that defines an opening, and that has two ends disposed respectively at opposite sides of said longitudinal axis, and pivotally and respectively connected to said base plate and said keycap, and a second scissor frame that is disposed in said opening, and that has two first ends opposite to each other along said longitudinal axis and pivotally and respectively coupled to said first scissor frame, and two second ends disposed respectively at opposite sides of said longitudinal axis, and pivotally and respectively connected to said base plate and said keycap, said second scissor frame further having a through hole through which said elastomeric component passes;

wherein said first scissor frame has parts that are connected to said base plate, said second scissor frame, and said keycap, and that are made of plastic;

wherein said second scissor frame has parts that are connected to said base plate, said first scissor frame and said keycap, and that are made of plastic[;

wherein one of said first scissor frame or said second scissor frame is made of plastic and metal; and wherein said first scissor frame includes a first scissor frame body that is made of plastic, that defines said opening, and that is pivotally connected to said base plate, said second scissor frame and said keycap, and an insert body that is made of metal and that is engaged to said first scissor frame body.

2. The long key device as claimed in claim 1, wherein:

said first scissor frame body has a first side bar extending in said longitudinal direction and detachably and pivotally connected to said keycap, two lateral bars, each being perpendicular to said first side bar and having opposite first and second ends, said first ends of said lateral bars being connected respectively to opposite ends of said first side bar, said lateral bars being connected respectively and pivotally to said first ends of said second scissor frame, and a second side bar connected between said second ends of said two lateral bars, and cooperating with said first side bar and said two lateral bars to define said opening, said first and second ends of each lateral bar being pivotally and respectively connected to said keycap and said base plate; and said insert body is U-shaped, and has a linking panel extending in said longitudinal direction and fitted on an upper side of said first side bar, and two lateral panels spaced apart in said longitudinal direction, connected to said linking panel, and fitted respectively on upper sides of said two lateral bars.

3. The long key device as claimed in claim 2, wherein:

said insert body further has a plurality of clip holes formed in said linking panel and said lateral panels; and said first scissor frame body further has a plurality of studs protruding from said first side bar and said two lateral bars and detachably and respectively engaged with said clip holes.

4. The long key device as claimed in claim 2, wherein:

said first scissor frame body further has two bump units protruding from said two lateral bars respectively, each bump unit cooperating with the respective lateral bar to form a plurality of engagement spaces; and said insert body further has two protrusion units protruding respectively from said lateral panels, each protrusion unit including a plurality of protrusions that are engaged respectively with said engagement spaces on the respective one of said lateral bars.

5. The long key device as claimed in claim 2, wherein each lateral panel has a first lower surface abutting against the respective one of said lateral bars, and a second lower surface extending from said first lower surface, connected to said linking panel, and abutting against the respective one of said lateral bars, said first and second lower surfaces cooperatively defining a strengthening angle that ranges from 99° to 178° .

6. The long key device as claimed in claim 1, wherein said second scissor frame includes:

a second scissor frame body made of metal, disposed in said opening, being elongated along said longitudinal axis, and having said through hole; and two lateral interlocking members made of plastic, engaged respectively with opposite sides of said second scissor frame body along said longitudinal axis, disposed respectively at said second ends of said second scissor frame, and pivotally connected to said first scissor frame, each lateral interlocking member having opposite ends that are disposed respectively at opposite sides of said longitudinal axis and that are pivotally and respectively connected to said base plate and said keycap.

7. The long key device as claimed in claim 6, wherein:

said first scissor frame has two shaft holes facing said two lateral interlocking members respectively;

each lateral interlocking member has a lateral interlocking member body, a shaft rod protruding from said lateral interlocking member body and rotatably engaged with a respective one of said respective shaft holes, and a plurality of engaging grooves formed in a side of said lateral interlocking member body that is opposite to said shaft rod; and said second scissor frame further includes two lateral protrusion units disposed respectively on opposite sides thereof along said longitudinal axis, each lateral protrusion unit having a plurality of lateral protrusions that are respectively engaged with said engaging grooves of a respective one of said lateral interlocking members.

8. The long key device as claimed in claim 6, wherein said second scissor frame further includes:

at least one first interlocking member that is made of plastic, that is mounted to one end of said second scissor frame body disposed at one side of said longitudinal axis, and that is detachably and pivotally connected to said base plate; and at least one second interlocking member that is made of plastic, that is mounted to an opposite end of said second scissor frame body disposed at an opposite side of said longitudinal axis, and that is detachably and pivotally connected to said keycap.

9. A long key device comprising:

a base plate extending in a longitudinal direction;

a thin film circuit board extending in said longitudinal direction and disposed on said base plate;

an elastomeric component disposed on a side of said thin film circuit board that is opposite to said base plate;

a keycap extending in said longitudinal direction and located above said elastomeric component; and a scissor mechanism disposed between said base plate and said keycap, and being elongated along a longitudinal axis that extends in said longitudinal direction, said scissor mechanism including a first scissor frame that defines an opening, and that has two ends disposed respectively at opposite sides of said longitudinal axis, and pivotally and respectively connected to said base plate and said keycap, and a second scissor frame that is disposed in said opening, and that has two first ends opposite to each other along said longitudinal axis and pivotally and respectively coupled to said first scissor frame, and two second ends disposed respectively at opposite sides of said longitudinal axis, and pivotally and respectively connected to said base plate and said keycap, said second scissor frame further having a through hole through which said elastomeric component passes;

wherein said first scissor frame has parts that are connected to said base plate, said second scissor frame, and said keycap, and that are made of plastic; wherein said second scissor frame has parts that are connected to said base plate, said first scissor frame and said keycap, and that are made of plastic;

wherein one of said first scissor frame or said second scissor frame is made of plastic and metal; and wherein said second scissor frame includes a second scissor frame body made of metal, disposed in said opening, being elongated along said longitudinal axis, and having said through hole, and two lateral interlocking members made of plastic, engaged respectively with opposite sides of said second scissor frame body along said longitudinal axis, disposed respectively at said second ends of said second scissor frame, and pivotally connected to said first scissor frame, each lateral interlocking member having opposite ends that are disposed respectively at opposite sides of said longitudinal axis and that are pivotally and respectively connected to said base plate and said keycap.

10. The long key device as claimed in claim 9, wherein:

said first scissor frame has two shaft holes facing said two lateral interlocking members respectively;

each lateral interlocking member has a lateral interlocking member body, a shaft rod protruding from said lateral interlocking member body and rotatably engaged with a respective one of said respective shaft holes, and a plurality of engaging grooves formed in a side of said lateral interlocking member body that is opposite to said shaft rod; and said second scissor frame further includes two lateral protrusion units disposed respectively on opposite sides thereof along said longitudinal axis, each lateral protrusion unit having a plurality of lateral protrusions that are respectively engaged with said engaging grooves of a respective one of said lateral interlocking members.

11. The long key device as claimed in claim 9, wherein said second scissor frame further includes:

at least one first interlocking member that is made of plastic, that is mounted to one end of said second scissor frame body disposed at one side of said longitudinal axis, and that is detachably and pivotally connected to said base plate; and at least one second interlocking member that is made of plastic, that is mounted to an opposite end of said second scissor frame body disposed at an opposite side of said longitudinal axis, and that is detachably and pivotally connected to said keycap.

12. The long key device as claimed in claim 9, wherein:

said first scissor frame includes a first scissor frame body that is made of plastic, that defines said opening, and that is pivotally connected to said base plate, said second scissor frame and said keycap, and an insert body that is made of metal and that is engaged to said first scissor frame body;

wherein said first scissor frame body has a first side bar extending in said longitudinal direction and detachably and pivotally connected to said keycap, two lateral bars, each being perpendicular to said first side bar and having opposite first and second ends, said first ends of said lateral bars being connected respectively to opposite ends of said first side bar, said lateral bars being connected respectively and pivotally to said first ends of said second scissor frame, and a second side bar connected between said second ends of said two lateral bars, and cooperating with said first side bar and said two lateral bars to define said opening, said first and second ends of each lateral bar being pivotally and respectively connected to said keycap and said base plate; and wherein said insert body is U-shaped, and has a linking panel extending in said longitudinal direction and fitted on an upper side of said first side bar, and two lateral panels spaced apart in said longitudinal direction, connected to said linking panel, and fitted respectively on upper sides of said two lateral bars.

13. The long key device as claimed in claim 12, wherein:

said insert body further has a plurality of clip holes formed in said linking panel and said lateral panels; and said first scissor frame body further has a plurality of studs protruding from said first side bar and said two lateral bars and detachably and respectively engaged with said clip holes.

14. The long key device as claimed in claim 12, wherein:

said first scissor frame body further has two bump units protruding from said two lateral bars respectively, each bump unit cooperating with the respective lateral bar to form a plurality of engagement spaces; and said insert body further has two protrusion units protruding respectively from said lateral panels, each protrusion unit including a plurality of protrusions that are engaged respectively with said engagement spaces on the respective one of said lateral bars.

15. The long key device as claimed in claim 12, wherein each lateral panel has a first lower surface abutting against the respective one of said lateral bars, and a second lower surface extending from said first lower surface, connected to said linking panel, and abutting against the respective one of said lateral bars, said first and second lower surfaces cooperatively defining a strengthening angle that ranges from 99° to 178° .

* * * * *